United States Patent [19]

Larson

[11] 4,449,303

[45] May 22, 1984

[54] SIGHTING SCREW UNIT FOR AND WITH ARCHERY BOWS

[76] Inventor: Marlow W. Larson, 2735 S. 4050 West, Ogden, Utah 84401

[21] Appl. No.: 489,500

[22] Filed: Apr. 28, 1983

[51] Int. Cl.[3] ..... F41G 1/00

[52] U.S. Cl. ..... 33/265; 124/87

[58] Field of Search ..... 33/265; 124/24 R, 87

[56] References Cited

U.S. PATENT DOCUMENTS

| | | | |
|---|---|---|---|
| 4,026,032 | 5/1977 | Smith | 33/265 |
| 4,136,462 | 1/1979 | Topel | 33/265 |
| 4,309,827 | 1/1982 | Larson | 33/265 |

*Primary Examiner*—Willis Little

*Attorney, Agent, or Firm*—M. Ralph Shaffer

[57] ABSTRACT

An improved sighting screw unit for and with archery bows wherein the sighting screw unit is adjustable up and down within a particular slot of a bracket mount attached to the bow. The unit cooperates with the slot in a rack-and-pinion type of engagement. Means is provided for frictionally engaging the sighting screw of the unit and is constructed for keying to the pinion portion of the adjustment member of the unit such that the screw will rotate in one-to-one relationship with such adjustment member of the unit. In this way there is no windage change of the screw relative to the unit as the latter is moved up and down within the bracket-slot provided. The structure is constructed and dimensioned, and preferably also marked, for accurate indications of changes in vertical position for individual position replacements.

12 Claims, 6 Drawing Figures

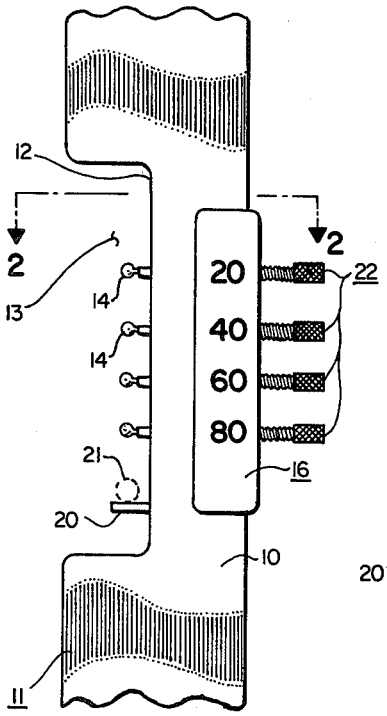
Fig. 1
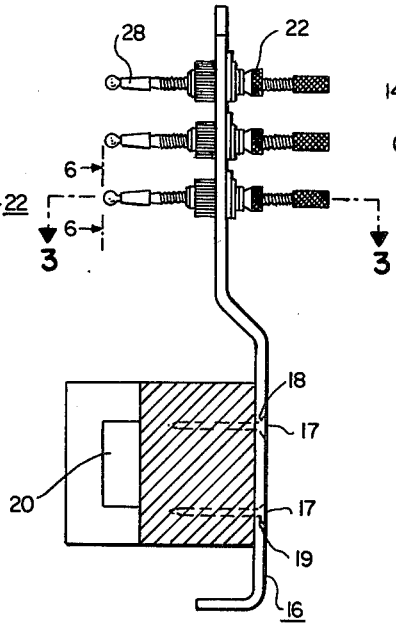
Fig. 2
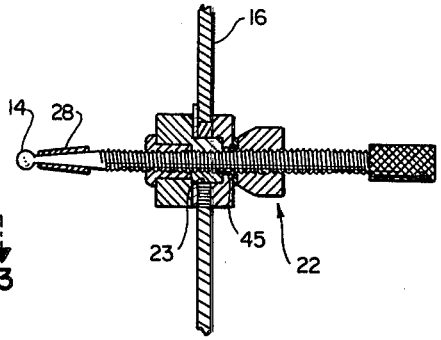
Fig. 3
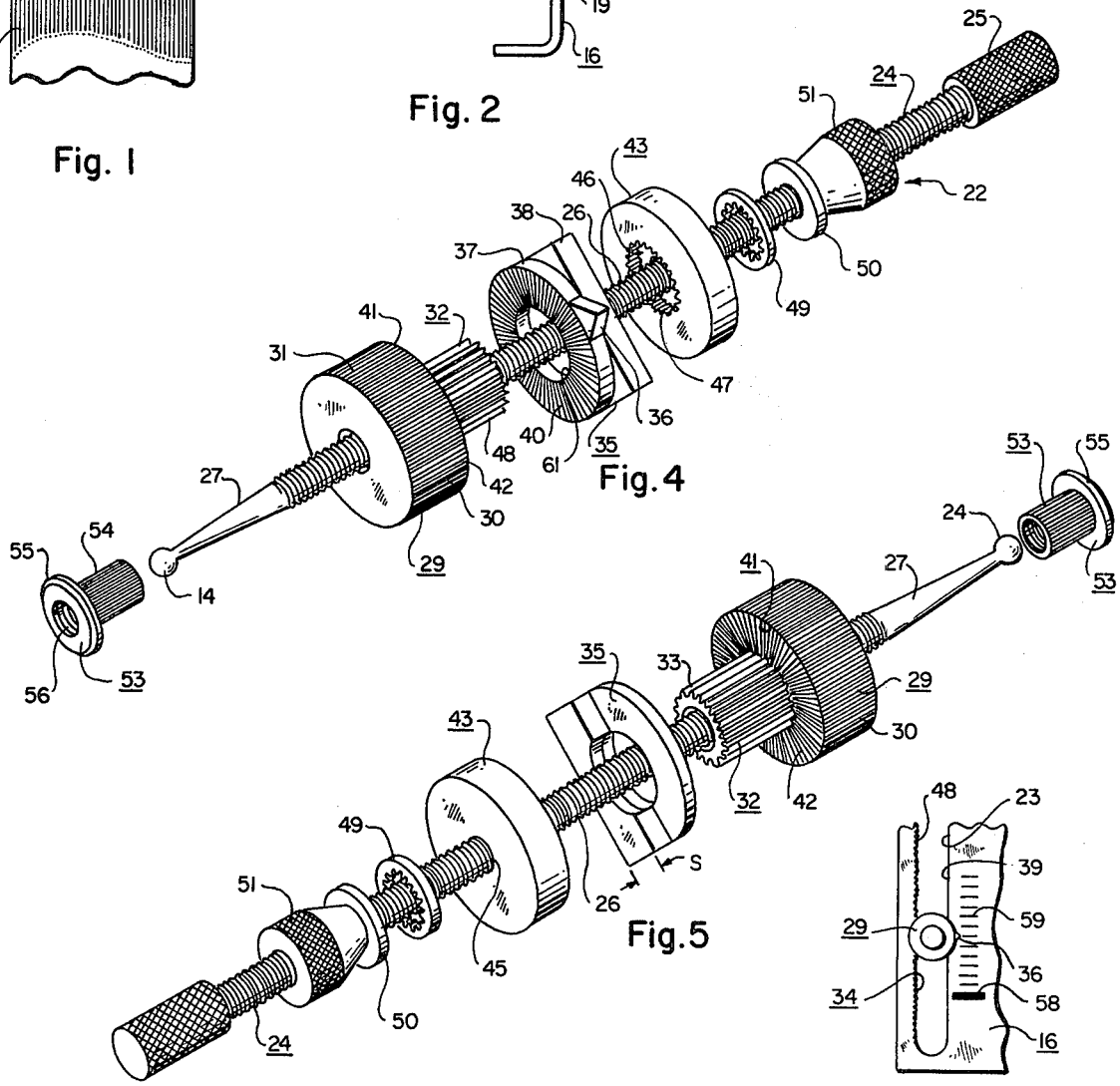
Fig. 4
Fig. 5
Fig. 6

SIGHTING SCREW UNIT FOR AND WITH ARCHERY BOWS

FIELD OF INVENTION

The present invention relates to sighting screw units for archery bows and, more particularly, to a new and improved sighting screw unit which can be adjusted vertically very accurately, and this without disturbing prior windage adjustment of the sighting bead of the screw construction.

BRIEF DESCRIPTION OF PRIOR ART

In the past a number of sighting screw units have been designed. Representative of these is one designed by the present inventor as found in U.S. Pat. No. 4,309,827. These and other types of sighting screw units are usable in archery bow constructions, and this where the individual sighting screws are mounted in vertical slots of the archery bow bracket utilized. The disclosure of the above mentioned patent is fully incorporated herein by way of reference. In the usual type of construction there is a somewhat loose metal-to-metal contact as between the sighting screw proper and threaded bushing or other unit employed to receive such screw. Accordingly, when the bushing through engagement with other means such as an adjustment knob, is caused to rotate so as to effect a vertical displacement or adjustment of the screw unit within its bracket slot, the screw itself may not always rotate in one-to-one relationship the threaded bushing and knob. What is needed, therefore, is a means for insuring that the screw rotates in perfect correspondence with the rest of the structure, at least that related to the adjustment knob and pinion portion thereof and also, preferably, to include pointer means for indicating the degree of vertical adjustment achieved during any particular rotational displacement of the adjustment knob of the unit that is related to the pinion thereof. The pinion, of course, will engage a rack formed by the side of a representative bracket slot. See the above aforementioned patent. No U.S. patents are currently known which teach the provision of suitable stuctural means for insuring the one-to-one rotational displacement of the screw of a sighting unit with its threaded mount.

BRIEF DESCRIPTION OF THE INVENTION

In accordance with the present invention the adjustment member of the sighting screw unit is provided with a knob that can be easily grasped by the thumb and fingers of the user. Such knob has a pinion extension which is constructed to engage the rack formed by the serrated teeth on one side of the slot of a suitably designed bracket. Such bracket of course is suitable for direct attachment to a medial portion of the archery bow utilizing the same. A pointer member is utilized over the pinion and includes a portion which engages at least one side of the slot such that the small pointer provided in such unit will always point in the direction transverse to the longitudinal axis of the slot. An elastomeric washer includes a splined depression designed to cooperate with the pinion portion of the adjustment knob, such washer also including a bore designed to be in friction engagement with the sighting screw utilized. The sighting screw itself has the usual sighting bead, tip cover, and knurled end suitable for windage adjustment. A nut and washer means are likewise provided.

The structure is assembled so that when the pointer member is disposed within the slot, the pointer extension is positioned to point to the central positioning of the unit relative to the archery bracket. The elastomeric washer is splined to and thereby engages the pinion portion and at the same time frictionally grips, at least to some extent, the sighting screw. The nut is tightened down on the sighting screw to urge star and plate washers against the elastomeric washer. When the screw nut is completely tightened down then, the corrugated surfaces provided the interior of the adjustment knob and the cooperating surface of the pointer mutually interengage so that the knob is fixed against rotational displacement during the interval the nut is tightened down. When the nut is loosened, then the corrugations are permitted to disengage so that the pointer member can slide up and down within the bracket slot as the pinion is rotated by the adjustment knob provided. It is to be noted that the elastomeric washer utilized, in being keyed to the adjustment member also frictionally engaging the screw, will cause the screw to rotate in accordance with the rotation of the adjustment knob, in one-to-one relationship, so that there will not occur an inadvertent windage readjustment during the vertical readjustment of the entire unit. Once the unit is fixed in a new vertical location relative to the archery bracket, the screw itself may be turned for new windage adjustment while the screw nut remains tightened, this by the screw threading not only through the nut but through the insert provided the adjustment member which threadedly receives the screw.

OBJECTS

Accordingly, a principal object of the present invention is to provide an improved sighting screw unit for archery bows.

A further object is to provide a sighting screw unit which can be adjusted not only for windage but also for a new vertical placement the latter in a manner such that the windage location of the sighting bead is not inadvertently displaced from that previously set.

A further object is to provide a friction lock for a sighting screw while the latter is adjusted up and down in an archery bow bracket slot, this such that any rotational member effecting a vertical adjustment of the sighting screw unit will be keyed to the friction means retaining the sighting screw in essentially keyed or one-to-one rotation relationship with adjustment means provided the screw.

A further object is to provide a positive lock for the adjustment member of a sighting screw unit so that when the unit is tightened the member cannot be inadvertently rotationally displaced.

IN THE DRAWINGS

The present invention may best be understood by reference to the following description, taken in connection with the accompanying drawings in which:

FIG. 1 is an enlarged fragmentary rear view of an archery bow incorporating a bracket and sighting unit of the present invention.

FIG. 2 is a horizontal section looking down and taken along the line 2—2 in FIG. 1.

FIG. 3 is an enlarged, longitudinal section of a representative sighting screw unit of the invention and is taken along the line 3—3 in FIG. 2.

FIGS. 4 and 5 are exploded perspective views, in reverse directions, of the representative sighting screw unit of FIG. 3.

FIG. 6 is a fragmentary side elevation, taken along the line 6—6 in FIG. 2, of a portion of the archery bracket indicating a representative slot having a slot side which is toothed to form a rack cooperating with the pinion portion of the sighting screw unit.

DETAILED DESCRIPTION OF PREFERRED EMBODIMENTS

In FIGS. 1-3 note the central portion 10 of archery bow 11 is provided with a recessed surface 12 defining a recess area 13. The sighting beads 14 of the various sighting units thus can be easily seen. Bracket 16 is provided with screws or other attachment means at 17 which proceed through apertures 18 and 19 into the bow proper as seen in FIG. 2. The usual arrow rest extension 20 will be provided for particular arrows 21. Sighting screw units 22 are mounted in one or more slots 23 of the bracket 16. See FIG. 6 and the inventor's prior patent, U.S. Pat. No. 4,309,827, fully incorporated herein by way of reference.

In considering FIGS. 3-5 it is noted that each of the sighting screw units, a representative one being shown at 22, has an adjustable sighting screw 24 provided with larged knurled end 25 and a shank 26 terminating in a tapered end portion 27 provided bead 14. If desired, plastic or other types of tapered jackets 28 may be provided each of the sighting screws to further delineate the sighting bead for the archer. An adjustment member 29 includes a knob portion 30 having a serrated or knurled surface 31 that is easily grasped and manipulated by the thumb and fingers of the user. Knob portion 30 is provided with an integral, axially outwardly extending pinion portion 32, the teeth of which are designed to engage the teeth 48 of rack 34 formed in slot 23. It is to be noted preliminarily at this juncture that the rotation of knob portion 30 will produce a corresponding rotation of the pinion at 32 so as to produce an up and down movement of the pinion and hence of the contained screw 24 within slot 23 of the archery bow bracket.

In proceeding to a further consideration of FIGS. 4 and 5 it is noted that a pointer member 35 includes pointer 36 and also portions 37 and 38. Portion 38 is a straight-sided and, in one form of the invention, such side is held against a smoothe slot side by pinion 32 contacting tightly the pointer member at its bore and engaging rack teeth 48 to exactly engage the upper surfaces of teeth 48 and the side 39 of the slot. In addition, the portion 37 includes radially corrugated surface 40 which cooperates with a similarly corrugated surface 41 at the interior surface 42 of knob portion 30. The purpose for these shallow corrugations will be explained hereinafter.

In proceeding with the construction it is noted that an elastomeric washer 43 is provided. The same may be plastic if desired. The essential feature is that the washer 43 be of such construction that it can retentively frictionally engage the screw 34 without being threaded thereon. Accordingly, the interior bore of the washer at 45 will relatively tightly encompass the screw so as to frictionally engage the same and yet permit the screw to be movably rotated. Furthermore, washer 43 includes a depression 46 provided with an interior splined area 47 dimensioned to cooperate with the teeth 48 of pinion portion 32. Star washer 49 and flat washer 50 are provided the nut 51 that is threaded onto the threaded shank 26 of adjustment screw 24. An internal threaded insert 53 includes an outwardly splined shank 54 and a flange 55. The insert 53 is internally threaded at 56 to receive the threaded shank 26 of the sighting screw. Prior to assembly the insert 53 will be pressed into the knob portion 30 of adjustment member 29 and the splines at 54 will cut cooperating spline recesses into the interior preferably plastic surface of the knob portion 30.

FIGS. 3 and 4 illustrate the adjustment screw unit in exploded view, seen from opposite directions, with the various parts being tightened down as illustrated in FIG. 3 accordingly.

As to the bracket 16, the same may be employed with pieces of tape 57 and/or vertically spaced horizontal markings 59 to cooperate with pointer 36 so that the user might perceive "where he is" relative to vertical adjustment. It is seen in FIG. 3, taken in conjunction with FIGS. 4 and 4, that member 35 will be disposed over pinion portion 32 of adjustment member 29. The interior bore 61 of pointer member 35 will be designed to relatively tightly engage the pinion portion 32, this for coaxial alignment purposes. It will be noted however that where the nut 51 is backed off, then the corrugations at 40 of pointer member 35 will be slightly out of engagement with, or readily disengagible the corresponding corrugated surface 41 of the knob portion 30. Where the corrugations are in engagement relative to these two surfaces, as produced by the tightening down of nut 51, then it will be noted that any inadvertent brushing against the knob portion 30 of the user's hand or other objects will not produce any inadvertent rotational displacement in the pinion gear or inadvertent vertical displacement of the entire sighting screw. This is because the width of the slide portion S of the pointer will be exactly dimensioned to the slot width, or less, so that there will be no angular displacement or otherwise of the pointer, now enmeshed with surface 41 of adjustment member, to otherwise produce misalignment.

In operation, assume now that the user wishes to adjust the sighting screw to a new marking 59 in FIG. 6. In such event he will loosen the nut 51 so that slight rotative pressure of the knob portion 30 will free the knob from the corrugated surface 40 of the pointer and permit the pinion portion 32 to ride up or down along the teeth 33 of rack 34 of the bracket 16. It will be noted that at this same time, since the washer 43 will be in splined engagement with the pinion portion 32, such washer, in frictionally gripping surfaces of the threads of the adjustment screw, will cause the screw likewise to turn. Accordingly, the entire sighting screw unit turns in one-to-one relationship, preparatory to the subsequent, fixed, longitudinal repositioning of the pointer. Thus, it is washer 43 that aids and supplements the frictional forces between the threads of insert 53 and the screw's threads so that chances of inadvertent windage relocation relative to the bead 14 is drastically reduced if not eliminated. Accordingly, any vertical readjustment of the sighting unit will not disturb the windage setting of the sighting screw, this is because of the important principle of a frictional contact of the washer 43 relative to the outer surfaces of the threads. Washer 43 may be internally threaded to receive the threaded shank of the adjustment screw, but such need not necessarily be the case. Thus, the aperture 45 of washer 43 may simply relatively tightly encompass the threads of adjustment screw 24. Once a new vertical location is achieved, as desired and as noted by pointer 36 relative to markings 59 or tape 58, then nut 51 is simply tightened down so that the unit is fixed in position and the corrugated surfaces, of very slight depth, of the knob portion 30 at 41 and the pointer member 35 at 40, are re-engaged. This, again, serves to include inadvertent additional displacements of a knob portion 30 which might otherwise disturb the vertical adjustment settings. Rather than corrugations at 40 and 41, an increased frictional surface at both of these locations may be provided the elastomeric means by roughened surfaces, or otherwise.

Accordingly, it is seen that improved archery bow sighting units are provided which units facilitate both horizontal windage adjustments and all vertical range adjustments relative to such units as to their associated archery bow bracket. It is important to note that the unit is designed so that windage setting is not disturbed during intervals of vertical range adjustments of the units. Once vertical adjustment is set, windage readjustment can easily be made if positively desired and positive action is taken. Additionally, inadvertent bumping or rubbing against the knob of the adjustment member, while nut 51 is tightened, will not cause a rotation of such knob and pinion, this owing to the cooperation of the corrugated surfaces aforementioned and the tight disposition of the slide portion 38 of pointer member 35 and the similarly dimensioned slot 23, as to width, of bracket 16.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A sighting screw unit for archery bows, said sighting screw unit including, in combination: a sighting screw having a manually graspable end, a sighting bead, and a threaded shank integrally disposed therebetween; adjustment means threadedly mounted upon said threaded shank and having a graspable rotatable knob and an axially projecting pinion of less radial dimension than said knob; a backing washer having a splined recess constructed to keyingly engage said pinion, said washer being provided with a central bore the surace of which frictionally engages said threaded shank; and nut means backing said washer.

2. The structure of claim 1 wherein said adjustment means comprises and adjustment member and an internally threaded insert splined into said adjustment means and threadedly engaging said threaded shank.

3. The structure of claim 1 wherein said sighting screw is provided with a pointer member apertured to be journaled over said pinion portion, having a horizontal pointer, and provided with a slide portion dimensioned to slide up and down the vertical slot of an external archery bow bracket without rotation, said pointer member thus being disposed between said washer and said knob and positioned over said pinion portion.

4. The structure of claim 3 wherein said knob and said pointer member have mutually-facing raised friction surfaces.

5. The structure of claim 4 wherein said friction surfaces comprise mutually engagable radially corrugated surfaces.

6. In the combination of a sighting bow bracket having at least one range adjustment slot and a sighting screw unit adjustably disposed in said slot; an improvement wherein said slot is provided with a toothed edge forming a rack, said sighting screw unit comprising: a sighting screw; and adjustment member threaded onto said sighting screw and having knob means overlapping said slot at one side of said bracket and a pinion portion operatively disposed within said slot and engaging said rack; a washer disposed on the remaining side of said bracket, frictionally engaging said sighting screw, and keyingly engaging said pinion; and attachment means disposed on said sighting screw for thrustingly tightening said knob and said washer toward opposite sides of said bracket.

7. The structure of claim 6 wherein said washer has a splined recess cooperatively engaging said pinion portion.

8. The structure of claim 6 wherein said screw is provided with a pointer member having a slide portion dimensioned for tight slideable positioning in said bracket slot, said pointer member having a pointer overlapping said slot, and said pointer member having a radially corrugated surface, said knob of said adjustment member also having a radially corrugated surface cooperating with that of said pointer member when said sighting screw unit is tightened by said attachment means onto said bracket.

9. The structure of claim 9 wherein said bracket has marking means cooperating with said pointer.

10. The structure of claim 8 wherein said washer is elastomeric.

11. A sighting screw unit for a slotted archery bow bracket having a rack, including, in combination: a sighting screw; pinion means threaded onto said sighting screw and constructed for engagement with said rack, said pinion means having a manually adjustable adjustment knob; a washer keyed to said pinion and constructed to back said bracket; an attachment means disposed on said sighting screw for backing said washer.

12. The sighting screw unit of claim 11 wherein said sighting screw includes a pointer member encompassing said pinion and constructed for cooperation with said external bracket.

* * * * *